US006223978B1

(12) United States Patent
Drager

(10) Patent No.: US 6,223,978 B1
(45) Date of Patent: May 1, 2001

(54) OCTAGONAL PACKAGE

(75) Inventor: Shawn P. Drager, Milwaukee, WI (US)

(73) Assignee: Packaging Corporation of America, Lake Forest, IL (US)

( * ) Notice: Subject to any disclaimer, the term of this patent is extended or adjusted under 35 U.S.C. 154(b) by 0 days.

(21) Appl. No.: 09/338,965

(22) Filed: Jun. 24, 1999

(51) Int. Cl.[7] ..... B65D 5/24

(52) U.S. Cl. ..... 229/109; 229/145; 229/186; 229/906; 493/80; 493/153; 493/162

(58) Field of Search ..... 229/109, 110, 229/145, 186, 902, 906; 493/59, 79, 80, 153, 162

(56) References Cited

U.S. PATENT DOCUMENTS

| | | | |
|---|---|---|---|
| 285,456 | | 9/1883 | Brehmer . |
| 1,052,564 | | 2/1913 | Brown . |
| 1,767,733 | | 6/1930 | Brown . |
| 1,865,742 | | 7/1932 | Chapman . |
| 1,960,635 | | 5/1934 | Kinkenon . |
| 2,147,563 | | 2/1939 | Turner . |
| 2,646,916 | | 7/1953 | Meller . |
| 2,663,488 | | 12/1953 | Gibbons . |
| 2,784,900 | | 3/1957 | Bauer . |
| 2,819,833 | | 1/1958 | Sauer . |
| 2,900,122 | | 8/1959 | Steiner . |
| 3,067,921 | | 12/1962 | Reifers . |
| 3,165,253 | | 1/1965 | Adams et al. . |
| 3,273,779 | | 9/1966 | Mykleby . |
| 3,276,900 | | 10/1966 | Funck . |
| 3,343,744 | | 9/1967 | Morell et al. . |
| 3,344,973 | | 10/1967 | Studen . |
| 3,512,697 | | 5/1970 | Robinson . |
| 3,542,282 | | 11/1970 | Troth . |
| 3,734,391 | * | 5/1973 | Manizza ..... 229/186 |
| 3,923,234 | | 12/1975 | Lund, Jr. . |
| 3,949,931 | | 4/1976 | Hall . |
| 4,058,214 | | 11/1977 | Mancuso . |
| 4,190,757 | | 2/1980 | Turpin et al. ..... 219/10.55 |
| 4,237,171 | | 12/1980 | Laage et al. ..... 426/127 |
| 4,362,265 | | 12/1982 | Williams . |
| 4,391,833 | | 7/1983 | Self et al. ..... 426/523 |
| 4,441,626 | | 4/1984 | Hall . |
| 4,765,534 | | 8/1988 | Zion et al. ..... 229/109 |
| 4,919,326 | | 4/1990 | Deiger ..... 229/109 |
| 5,000,374 | | 3/1991 | Deiger ..... 229/109 |
| 5,110,039 | | 5/1992 | Philips ..... 229/110 |
| 5,355,998 | * | 10/1994 | Bienaime ..... 206/427 |
| 5,358,173 | | 10/1994 | Mertz ..... 229/110 |
| 5,368,225 | * | 11/1994 | Ritter ..... 229/906 |
| 5,402,929 | | 4/1995 | Ritter et al. ..... 229/110 |
| 5,419,486 | | 5/1995 | Bennett et al. ..... 229/109 |
| 5,452,845 | | 9/1995 | Ritter ..... 229/110 |
| 5,535,940 | | 7/1996 | Olds ..... 229/110 |
| 5,702,054 | | 12/1997 | Philips et al. ..... 229/110 |
| 5,806,755 | * | 9/1998 | Correll ..... 229/906 |
| 5,890,649 | * | 4/1999 | Baxter ..... 229/186 |

FOREIGN PATENT DOCUMENTS

| | | | |
|---|---|---|---|
| 21682/35 | | 3/1935 | (AU) . |
| 1269941 | * | 6/1968 | (DE) ..... 229/186 |
| 3218174 | * | 11/1983 | (DE) ..... 229/109 |
| 1320926 | | 12/1962 | (FR) . |
| 2329523 | | 10/1975 | (FR) . |
| 2408525 | | 8/1979 | (FR) . |
| 2018226A | | 4/1978 | (GB) . |
| 2116150A | | 9/1983 | (GB) . |

* cited by examiner

*Primary Examiner*—Gary E. Elkins
(74) *Attorney, Agent, or Firm*—Jenkens & Gilchrist

(57) ABSTRACT

A quickly and easily erected octagonal package for round items such as pizza, cakes and pies includes a top and a bottom. The bottom includes a front wall, a rear wall and a pair of side walls. The side walls are foldably connected to the front and rear walls by bridging panels at corners of the package. The connection provided by the bridging panels allows the bottom and all its walls to be erected quickly and easily.

8 Claims, 4 Drawing Sheets

OCTAGONAL PACKAGE

FIELD OF THE INVENTION

The present invention relates to a package, and, more particularly, to an easily erected package for round food items such as cakes and pizzas and for round hard goods such as disc brake rotors.

BACKGROUND OF THE INVENTION

The typical package for a product is of a square or rectangular configuration. These packages are stored in a flat configuration and erected by hand when the package is needed for a retail product.

Although a square or rectangular package configuration is adequate for many products, it is less desirable for round products such as pizzas, cakes and round hard goods such as disc brake rotors. A round product in a square or rectangular package is not securely held in position such that if the package is tilted, the product can more easily shift and can be damaged. In order to protect round products it is desirable to provide a package that is more nearly round than square.

An advantage of existing square or rectangular packages, however, is typically they can be erected quickly by hand. It is preferable that any other package shape also have this capability.

Round packages are available but many of these are of a weak vertical structural strength. This weakness limits the stackability of these packages because they cannot support the weight of several packages stacked onto each other. Thus, structural strength, particularly vertical structural strength, is a desirable feature of any package configuration. Existing round packages are also difficult to erect, and it is desirable to provide a round package that can be quickly erected.

SUMMARY OF THE INVENTION

The present invention is directed to a package for round products including food products such as pizzas and cakes and hard goods such as disc brake rotors. The package of the present invention is generally octagonal and includes a bottom and a cover or lid hinged to the bottom. The cover includes side walls and a locking flap for securing the cover in a closed position onto the bottom. The bottom includes two side walls, a front wall and a rear wall. Bridging panels hingedly interconnect the front wall and the rear wall to each side wall so that as the bottom is erected, the bridging panels cause the rear, front and side walls to erect as a unit. The bridging panels fold into corners of the octagonal package providing vertical structural strength.

BRIEF DESCRIPTION OF THE DRAWINGS

Other objects and advantages of the invention will become apparent upon reading the following detailed description and upon reference to the drawings in which.

DETAILED DESCRIPTION OF ILLUSTRATIVE EMBODIMENTS

The package 10 of the present invention supports round food products such as cakes, pizzas and pies and round non-food products such as disk brake rotors. The package 10 is octagonal and engages a round product on eight sides rather than on four sides as provided by a square or rectangular package. By providing twice as many points of contact with the product, the package 10 gives greater protection for round products than provided by a square or rectangular package.

The package 10 can be manually erected in one step. This allows one person to erect the package 10 and place a round product, such as a pizza, cake or pie in the package 10 quickly and easily. Because the package 10 can be quickly and easily erected, it can also be used in semiautomated and automated packing lines.

Figure 1:
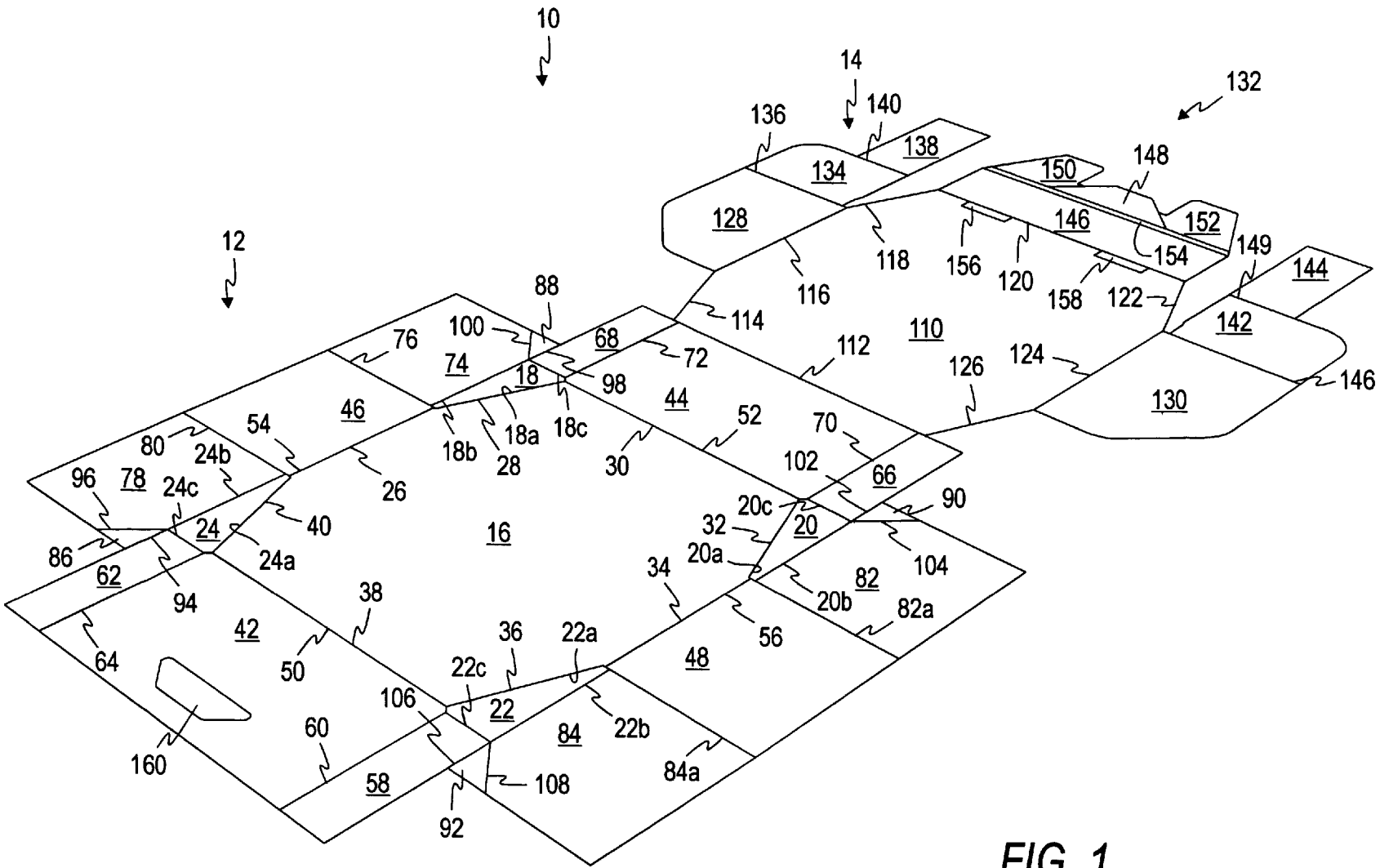
FIG. 1 is a perspective view of a package in its flat configuration constructed in accordance with the principles of the present invention.

The package 10 includes a tray or bottom 12 and although not necessary to the invention, may include a cover 14. The tray 12 is octagonal so as to conform more nearly in shape to a round product that is to be supported in the tray 12. The tray 12 is illustrated in FIG. 1 in a flat position for storage which is also in a position ready to be erected.

The tray 12 includes a bottom panel 16 on which a product rests. The bottom panel 16 may be square or, in the embodiment illustrated, have triangular portions 18 20, 22 and 24 (FIG. 1) that, in one embodiment, are removed. The triangular portions 18, 20, 22, 24 are defined by cut lines 18*a–c*, 20*a–c*, 22*a–c*, 24*a–c*, respectively, which result in the triangular portions 18, 20, 22, 24 being removed from the bottom panel 16 to provide eight sides 26, 28, 30, 32, 34, 36, 38 and 40 on the bottom panel 16. Alternatively, the triangular portions 18, 20, 22, 24 can remain part of the bottom panel 16 but are separate from and not connected to the corner panels or end portions 58, 62, 66 68, 74, 78, 82, 84.

The tray 12 also includes four walls that surround the bottom panel 16 and are moved from a flat position (FIG. 1) to a vertical position (FIG. 3) upon erection. These four walls are a front wall 42, a rear wall 44, a first side wall 46, and a second side wall 48. Each wall 42, 44, 46 and 48 is foldable relative to the bottom panel 16 along a score line 50, 52, 54 and 56, respectively.

In order for the walls 42, 44, 46 and 48 to form an octagon upon erection, each wall includes corner panels or end portions at opposite ends of each wall. The front wall 42 includes a first corner panel or end portion 58 which may be folded relative to the end wall 42 along a score line 60. A second corner panel or end portion 62 is provided on the end wall 42 along a score line 64. Due to the removed triangular portions 22 and 24, the first and second corner panels 58 and 62 are not directly connected to the bottom panel 16. If the triangular portions 22 and 24 are not removed, there is a cut line separating the portions 22 and 26 from the corner panels 58 and 62.

The rear wall 44 also includes first 66 and second 68 corner panels or end portions along score lines 70 and 72. The first 66 and second 68 corner panels or end portions are not connected directly to the bottom panel 16 due to the removed portions 18 and 20. If portions 18 and 20 are not removed, a cut line separates the portions 18 and 20 from the corner panels 66 and 68.

The side walls 46 and 48 also include corner panels or end portions. The first side wall 46 includes a first corner panel or end portion 74 extending from the side wall 46 along a score line 76. A second corner panel or end portion 78 is also provided on the first side wall 46 along a score line 80. Neither corner panel 74 or 78 is connected directly to the bottom panel 16 due to the cut out portions 18 and 24, respectively, or cut lines if the portions 18 and 24 are not removed.

Like the first side wall 46, the second side wall 48 also includes first 82 and second 84 corner panels or end portions along score lines 82a and 84a, respectively. These corner panels 82 and 84 also are not directly connected to the bottom panel 16 due to the removed portions 20 and 22 or cut lines if the portions 20 and 22 are not removed.

All of the walls 42, 44, 46 and 48 and their corner panels or end portions 58, 62, 66, 68, 76, 80, 82 and 84 are foldably interconnected by bridging or connecting panels 86, 88, 90 and 92. By all being interconnected, upon folding some of the walls to erect the package 10, the remaining walls and corner panels also are erected simultaneously. The bridging panels 86, 88, 90 and 92 are of triangular configuration and are part of or joined to adjacent corner panels along score lines. Specifically, the bridging panel 86 is joined to the corner panel 62 along a score line 94 and to the corner panel 78 along a score line 96. The bridging panel 88 is coupled to corner panel 68 along score line 98 and coupled to corner panel 74 along score line 100. The bridging panel 90 is attached to the corner panels 66 and 82 along score lines 102 and 104, respectively, and the bridging panel 92 is attached to the corner panels 58 and 84 along score lines 106 and 108, respectively.

Figure 2:
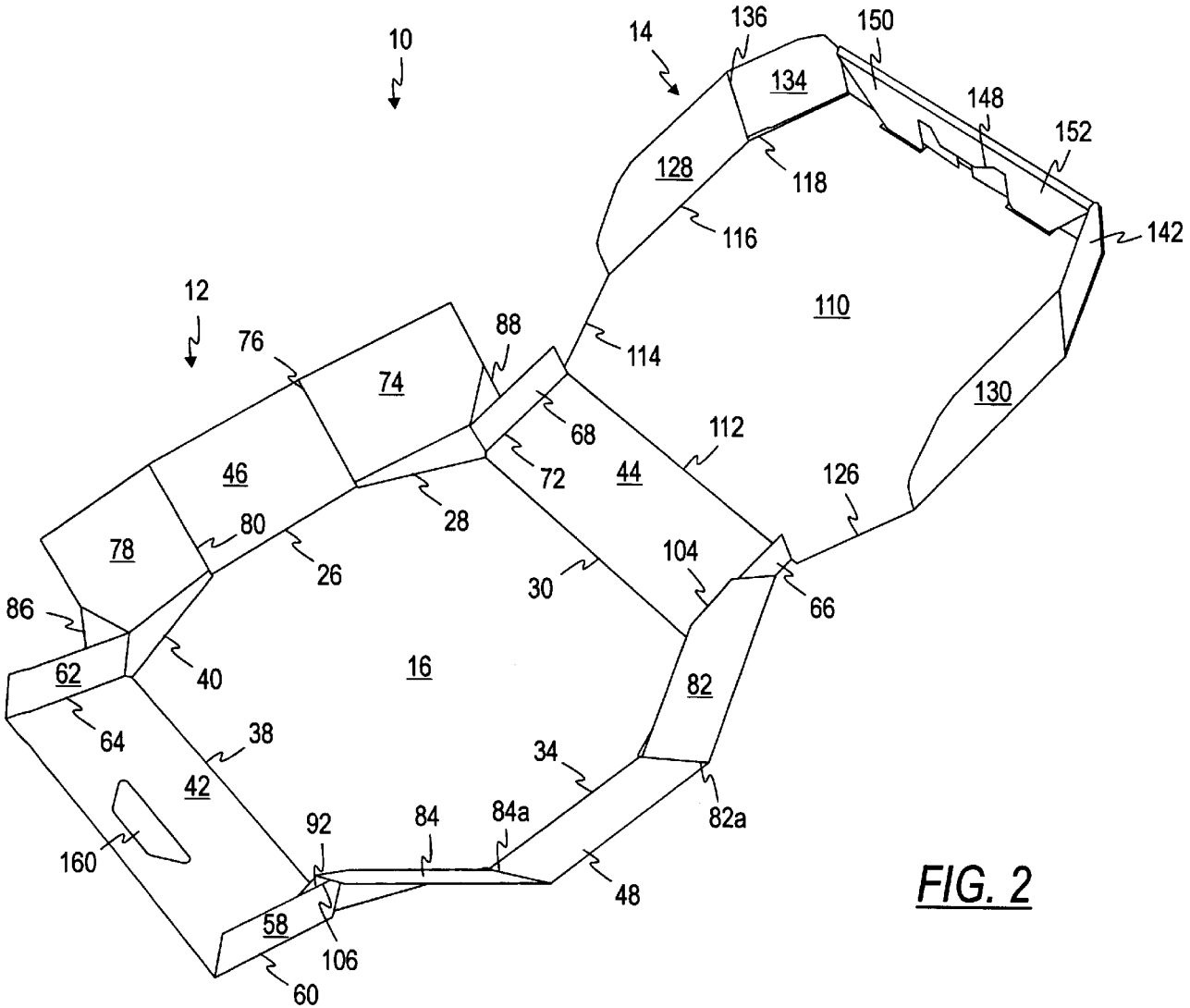
FIG. 2 is a view similar to FIG. 1 after a cover of the package has been folded and erection of the package is started by folding the walls of the package.
Figure 3:
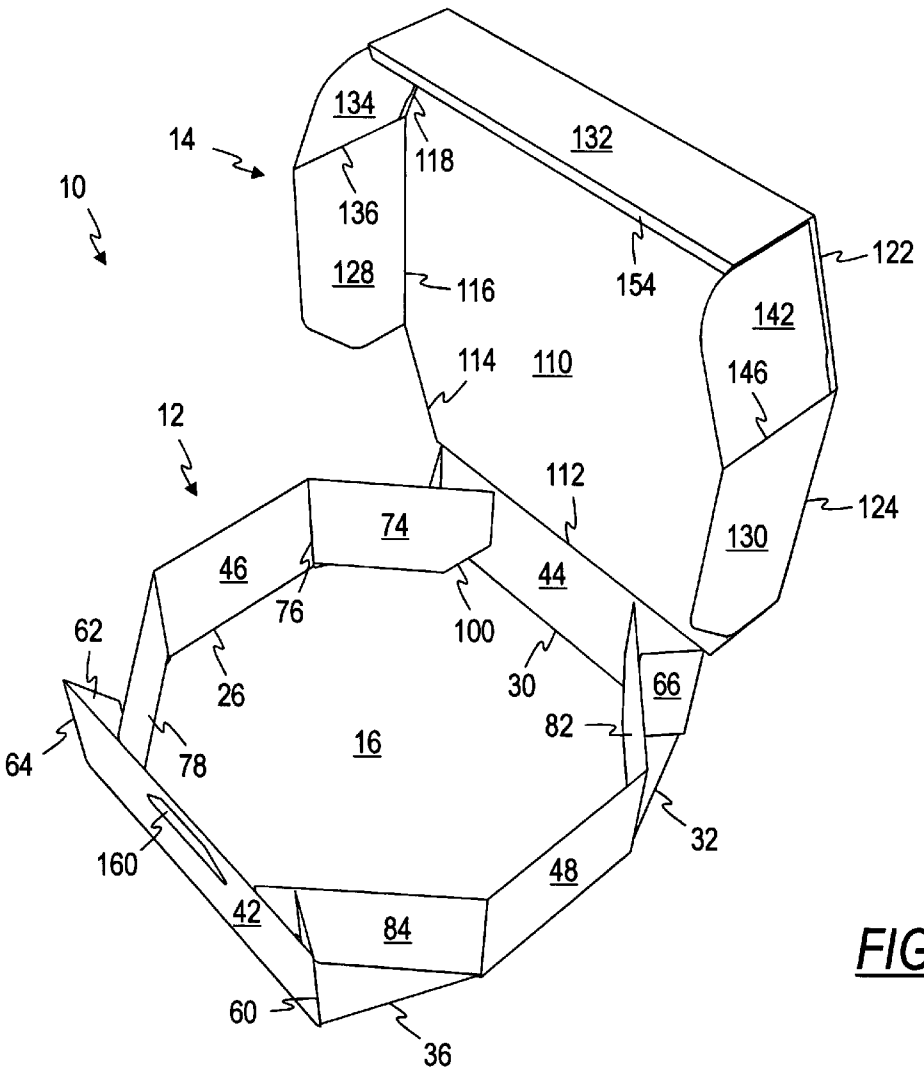
FIG. 3 is a view of the package upon substantially complete erection.

To erect the tray 12, one or more of the corners 72, 78, 82, 84 are folded upwardly relative to the bottom panel 16. The folding of the corners causes the wall panels associated with the corners to fold inwardly toward the bottom panel 16 and the bridging panels attached to folding corner panels are caused to fold along their score lines 96, 100, 104, 108. This folding action extends through the remaining walls, corner panels and bridging panels as illustrated in FIG. 2 until the tray 12 is fully erected as illustrated in FIG. 3. In this fully erected configuration (FIG. 3) the eight sides of the inside of tray 12 are defined by the front wall 42, the rear wall 44, the first side wall 46, the second side wall 48, and the corner portions 74, 78, 82 and 30 84.

The corners of the tray 12 defined in part by the bridging panels 86, 88, 90, 92 and the corner panels 58, 62, 66, 68, 74, 78, 82, 84 have more folds and material and provide greater vertical bearing area for more vertical or stacking strength than provided in the corners of prior art square or rectangular packages.

In some uses a cover or top 14 may be desired for the tray 12. The top 14 may be of any design compatible with the tray 12. In the embodiment illustrated, the top 14 is attached to the tray 12 and is of octagonal configuration; however, the top may be separate from the tray 12 and be octagonal or another suitable configuration.

Figure 4:
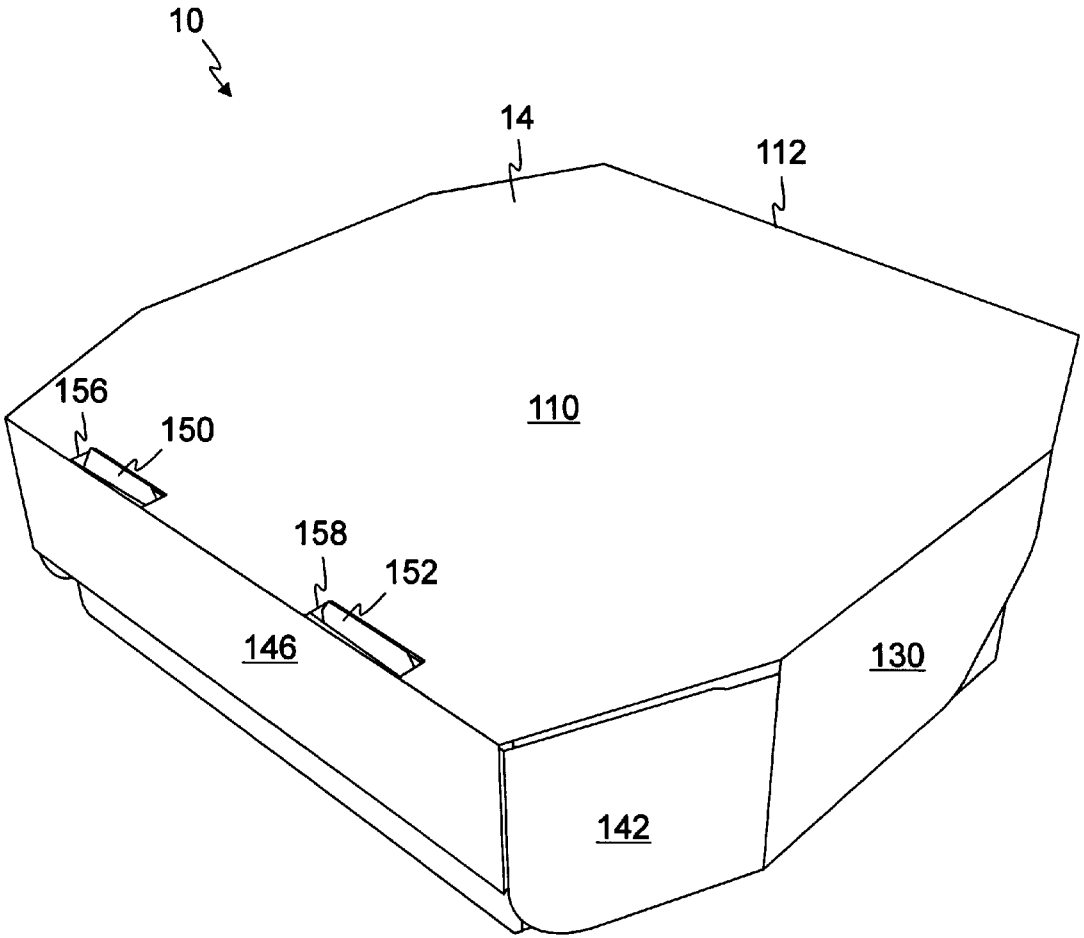
FIG. 4 is a perspective view of a fully erected package with its cover closed onto the bottom of the package.

The top 14 includes a central panel 110 that has eight edges 112, 114, 116, 118, 120, 122, 124 and 126. The edge 112 is a score line separating the rear wall 44 and the top 14 and about which the top 14 is folded to a position covering the tray 12 (FIGS. 2–4).

The top 14 includes a first side wall 128, a second side wall 130, and a latch 132. The first side wall 128 includes an extension 134 extending along a score line 136 An arm 138 extends from the extension 134 from a score line 140. Similarly, the second side wall 130 includes an extension 142 and an arm 144 along score lines 146 and 148, respectively.

The latch 132 is along edge 120 which is a score line allowing the latch 132 to be folded relative to the central panel 110. The latch 132 includes a central member 146, a latch tongue 148 and a pair of latch arms 150 and 152. The tongue 148 and arms 150, 152 are separated from the central member 146 along a double score line 154 such that the tongue 148 and arms 150, 152 can be folded relative to the central member 146.

The top 14 is assembled by folding the first and second side walls 128, 130 along the score lines 116 and 124 to a position approximately perpendicular to the central panel 110. The extensions 134, 142 and the arms 138, 144 are folded along the score lines 136, 146, 140, 148, respectively, to be against the central member 146. With the arms 138, 144 against the central member 146, the latch tongue 148 and latch arms 150, 152 are folded along the double score 154 and over the arms 138, 144. The ends of the latch arms 150, 152 are pushed into a pair of slots 156, 158 cut in the central panel 110 to lock the arms 150, 152 against the central member 146 and the arms 150, 152 forming a wall. The first side wall 128, the second side wall 130, the extensions 134, 142 and the arms 138, 140 are also locked into a vertical position perpendicular to the central panel 110 (FIG. 2).

As the tray 12 is erected in the manner previously described, the folding of the rear wall 44 brings the top 14 to a position over the tray 12 (FIGS. 2, 3). Once a product is placed in the tray 12, the top 14 can be folded down onto and covering the tray 12. The top 14 can be locked in this position by inserting the latch tongue 148 into an opening 160 cut into the front wall 42.

The package 10 is also reusable by performing the above described folding, erecting and assembling steps in reverse. This returns the package 10 to flat configuration (FIG. 1) allowing it to be stored for later use.

While the present invention has been described with reference to the particular embodiments illustrated, those skilled in the art will recognize that many changes and variations may be made thereto without departing from the spirit and scope of the present invention. The embodiments and obvious variations thereof are contemplated as falling within the scope and spirit of the claimed invention, which is set forth in the following claims:

What is claimed is:

1. A blank erectable into a package for round products, comprising:

an eight sided bottom panel;

a front wall foldably connected to a first side of said bottom panel;

a rear wall foldably connected to a second side of said bottom panel;

a first side wall foldably connected to a third side of said bottom panel;

a second side wall foldably connected to a fourth side of said bottom panel;

a first interconnecting panel connected to said front wall and said second side wall and separate from said bottom panel;

a second interconnecting panel connected to said front wall and said second side wall and separate from said bottom panel;

a third interconnecting panel connected to said rear wall and said first side wall and separate from said bottom panel; and a fourth interconnecting panel connected to said rear wall and said first side wall and separate from said bottom panel wherein said first, second, third and fourth interconnecting panels are in the shape of right triangles with the hypotenuse and one side of each right triangle connected to one of said front, rear or side walls along a score line.

2. The blank claimed in claim 1 wherein said first, second, third and fourth interconnecting panels are of generally triangular configuration.

3. The blank claimed in claim 1 wherein each said front, rear and side walls each includes a pair of corner panels connected by score lines at opposing ends of each said front, rear and side walls, and one of said first, second, third and fourth interconnecting panels being connected to one of said pair of corner panels along a score line.

4. The blank claimed in claim 3 further comprising a cut line between each said corner panel and said bottom panel.

5. The blank claimed in claim 1 wherein each said first, second, third and fourth interconnecting panel is separate from said bottom panel.

6. A method of erecting a package, comprising:

providing a bottom panel;

providing four walls foldably interconnected to said bottom panel, each said wall having two opposing ends;

providing a hinge panel on each end of each wall with a cut line between each said hinge panel and said bottom panel;

providing adjacent of said hinge panels with interconnecting panels; and folding at least one of said four walls relative to said bottom panel wherein said interconnecting panels pull said remaining walls of said four walls folding them relative to said bottom panel thereby erecting said package.

7. The method of erecting a package claimed in claim 6, further comprising providing a cover hingedly connected to one of said four walls, said cover moving over said bottom panel as said at least one of said four walls is folded relative to said bottom panel.

8. The method of erecting a package claimed in claim 6 further comprising removing a portion of said bottom panel adjacent said opposing ends of each said four walls.

* * * * *